US011885517B2

(12) United States Patent
Hirai et al.

(10) Patent No.: US 11,885,517 B2
(45) Date of Patent: Jan. 30, 2024

(54) AIR CONDITIONING AND VENTILATING SYSTEM THAT ENHANCE VENTILATION IN RESPONSE TO A REFRIGERANT LEAKAGE

(71) Applicant: DAIKIN INDUSTRIES, LTD., Osaka (JP)

(72) Inventors: Kousuke Hirai, Osaka (JP); Akiyoshi Yamamoto, Osaka (JP); Gakuto Sakai, Osaka (JP); Yoshitaka Matsugi, Osaka (JP); Tooru Fujimoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/688,186

(22) Filed: Mar. 7, 2022

(65) Prior Publication Data

US 2022/0186960 A1 Jun. 16, 2022

Related U.S. Application Data

(63) Continuation of application No. PCT/JP2020/033174, filed on Sep. 2, 2020.

(30) Foreign Application Priority Data

Sep. 30, 2019 (JP) ..... 2019-178824

(51) Int. Cl.
*F24F 11/36* (2018.01)
*F24F 11/49* (2018.01)
(Continued)

(52) U.S. Cl.
CPC ..... *F24F 11/36* (2018.01); *F24F 7/007* (2013.01); *F24F 11/49* (2018.01); *F25B 49/022* (2013.01);
(Continued)

(58) Field of Classification Search
CPC .. F24F 7/007; F24F 11/36; F24F 11/49; F25B 49/022; F25B 2313/0293; F25B 2500/222
See application file for complete search history.

(56) References Cited

U.S. PATENT DOCUMENTS

2009/0126375 A1 5/2009 Toyoshima et al.
2013/0174592 A1 7/2013 Yamashita et al.
(Continued)

FOREIGN PATENT DOCUMENTS

GB 2554267 A * 3/2018 ..... F24F 11/36
JP 2002-5548 A 1/2002
(Continued)

OTHER PUBLICATIONS

English translation of the International Preliminary Report on Patentability and Written Opinion of the International Searching Authority for International Application No. PCT/JP2020/033174, dated Apr. 14, 2022.
(Continued)

*Primary Examiner* — Jonathan Bradford
(74) *Attorney, Agent, or Firm* — Birch, Stewart, Kolasch & Birch, LLP

(57) ABSTRACT

A system includes an air conditioning device with a heat exchanger that sends conditioned air to an air conditioned space, a ventilation device that ventilates the air conditioned space, a refrigerant sensor that detects a concentration of a refrigerant in the air conditioned space, and a control unit that controls operations of the air conditioning device and ventilation device. On determination that the refrigerant concentration acquired from the refrigerant sensor exceeds a first predetermined value, the control unit sets an operation of a compressor of the air conditioning device to a stop state and sets the ventilation device to an operating state. On determination that the refrigerant concentration that has exceeded the first predetermined value becomes equal to or
(Continued)

less than the first predetermined value, the control unit continues the stop state of the compressor and operating state of the ventilation device until a predetermined timing.

8 Claims, 4 Drawing Sheets

(51) Int. Cl.
*F24F 7/007* (2006.01)
*F25B 49/02* (2006.01)

(52) U.S. Cl.
CPC . *F25B 2313/0293* (2013.01); *F25B 2500/222* (2013.01)

(56) References Cited

U.S. PATENT DOCUMENTS

| | | | | |
|---|---|---|---|---|
| 2015/0362204 | A1* | 12/2015 | Goel | F24F 11/38 62/180 |
| 2016/0245566 | A1* | 8/2016 | Hiraki | F24F 11/77 |
| 2017/0370605 | A1* | 12/2017 | Makino | F24F 1/0063 |
| 2018/0045424 | A1 | 2/2018 | Yajima et al. | |
| 2018/0135878 | A1* | 5/2018 | Iura | F24F 11/89 |

FOREIGN PATENT DOCUMENTS

| | | | | | |
|---|---|---|---|---|---|
| JP | 2011-106697 | A | | 6/2011 | |
| JP | 4799563 | B2 | | 10/2011 | |
| JP | 2012-13339 | A | | 1/2012 | |
| JP | 2015-94515 | A | | 5/2015 | |
| JP | 2015094515 | A | * | 5/2015 | F24F 1/0007 |
| JP | 2016-211762 | A | | 12/2016 | |
| JP | 2016-211826 | A | | 12/2016 | |
| JP | 2016-223643 | A | | 12/2016 | |
| JP | 2018-91550 | A | | 6/2018 | |
| JP | 2018-159475 | A | | 10/2018 | |
| WO | WO2012/049710 | A1 | | 4/2012 | |
| WO | WO-2012049710 | A1 | * | 4/2012 | F24F 1/06 |
| WO | WO2017/068686 | A1 | | 4/2017 | |

OTHER PUBLICATIONS

International Search Report, issued in PCT/JP2020/033174, PCT/ISA/210, dated Oct. 20, 2020.
JRA-GL-16: 2017; Guideline of design construction for enriching safety against refractory leakage from commercial air conditioners using lower flammability(A2L), total 56 pages.
Office Action issued in Japanese Patent Application No. 2019-178824 dated May 25, 2021.
Office Action issued in Japanese Patent Application No. 2019-178824 dated Oct. 13, 2020.
European Search Report dated Sep. 28, 2022 issued in corresponding European Patent Application No. EP 20 871 126.7.

* cited by examiner

AIR CONDITIONING AND VENTILATING SYSTEM THAT ENHANCE VENTILATION IN RESPONSE TO A REFRIGERANT LEAKAGE

CROSS REFERENCE TO RELATED APPLICATIONS

This application is a Continuation of PCT International Application No. PCT/JP2020/033174 filed on Sep. 2, 2020, which claims priority under 35 U.S.C. § 119(a) to Patent Application No. 2019-178824 filed in Japan on Sep. 30, 2019, all of which are hereby expressly incorporated by reference into the present application.

TECHNICAL FIELD

The present disclosure relates to air conditioning and ventilating systems. In more detail, the present disclosure relates to an air conditioning and ventilating system including an air conditioning device and a ventilation device.

BACKGROUND ART

In relatively large buildings such as office buildings and hotels, an air conditioning device that generates cold air and hot air, and a ventilation device that supplies outside air into the room and exhausts air from the room are usually used together.

If a refrigerant leaks from the air conditioning device into the room, an oxygen deficiency or other inconveniences may occur. To prevent an occurrence of such an inconvenience, it has conventionally been proposed to activate the ventilation device when refrigerant leakage is detected (see, for example, Patent Literature 1).

In the air conditioning and ventilating system described in Patent Literature 1, when refrigerant leakage is detected while an air conditioning device is connected to a ventilation device to communicate with each other, a control device of the air conditioning device instructs a control device of the ventilation device to operate the ventilation device. Then, if a trouble of the ventilation device or the like causes a shortage of airflow volume of the ventilation device, the control device of the air conditioning device increases the airflow volume of the air conditioning device. This inhibits the leaked refrigerant from accumulating in air conditioned space and causing insufficient discharge of the refrigerant.

CITATION LIST

Patent Literature

PATENT LITERATURE 1: Japanese Unexamined Patent Publication No. 2016-223643

SUMMARY

An air conditioning and ventilating system according to the present disclosure includes:

- an air conditioning device including a heat exchanger configured to generate conditioned air by heat exchange with a refrigerant, and configured to send the conditioned air to an air conditioned space;
- a ventilation device configured to ventilate the air conditioned space;
- a refrigerant sensor configured to detect concentration of the refrigerant in the air conditioned space; and
- a control unit configured to control operations of the air conditioning device and the ventilation device.

On determination that the refrigerant concentration acquired from the refrigerant sensor exceeds a first predetermined value, the control unit sets an operation of a compressor of the air conditioning device to a stop state and sets the ventilation device to an operating state.

On determination that the refrigerant concentration that has exceeded the first predetermined value becomes equal to or less than the first predetermined value, the control unit continues the stop state of the compressor of the air conditioning device and the operating state of the ventilation device until predetermined timing to prevent an unevenness of the refrigerant concentration in the air conditioned space.

DETAILED DESCRIPTION

An air conditioning and ventilating system according to the present disclosure will be described in detail below with reference to the accompanying drawings. Note that the present disclosure is not limited to the following exemplification, but is intended to include all changes within meanings and a scope of claims and equivalents.

[Overall Configuration of Air Conditioning and Ventilating System]

Figure 1:
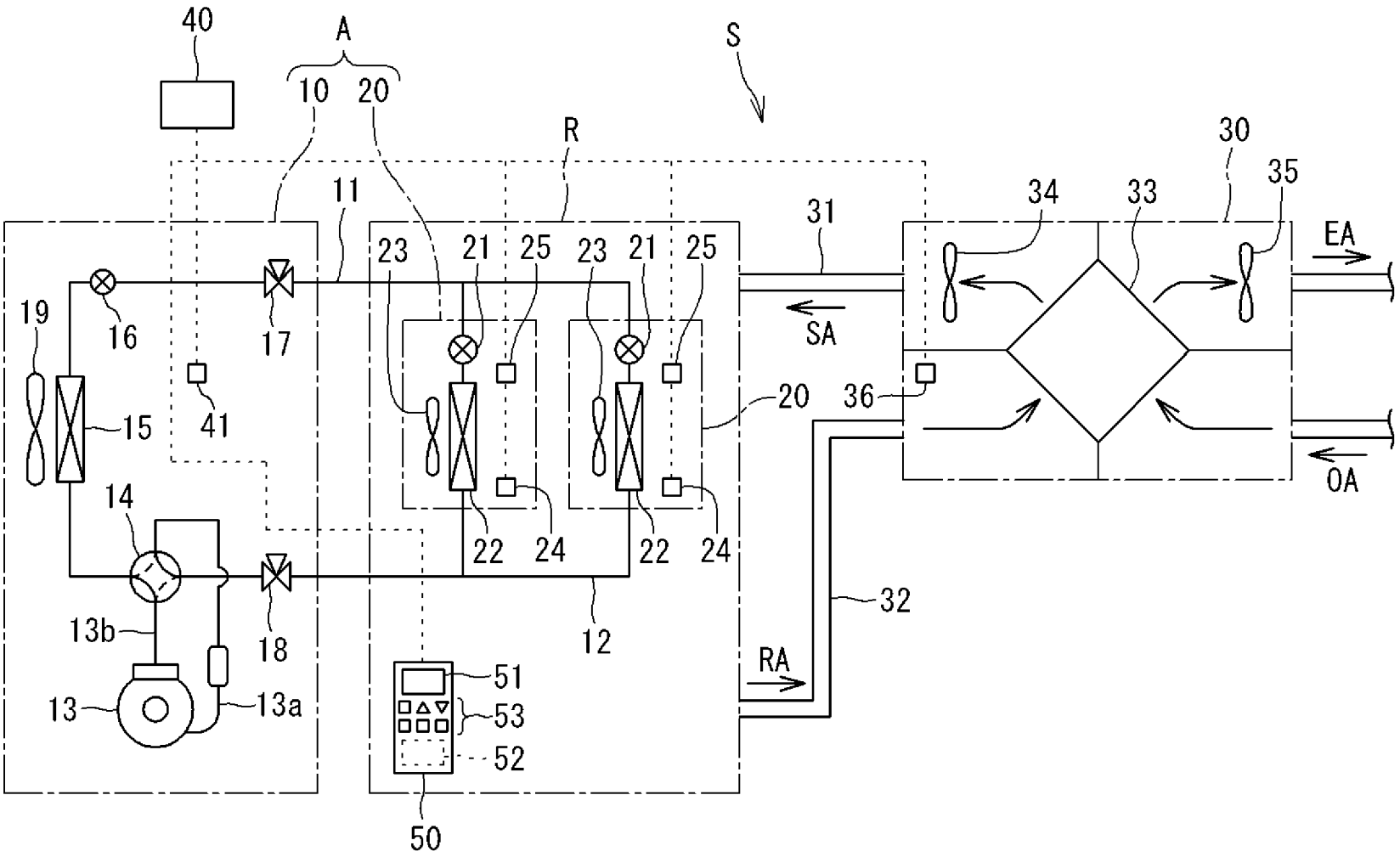
FIG. 1 is an explanatory diagram of a refrigerant pipe system and an air system of one embodiment of an air conditioning and ventilating system of the present disclosure.

FIG. 1 is an explanatory diagram showing a refrigerant pipe system and an air system of an air conditioning and ventilating system S according to one embodiment of the present disclosure. The air conditioning and ventilating system S includes a refrigerant pipe method distributed air conditioning device. The air conditioning and ventilating system S cools and heats a room R by executing a vapor compression refrigeration cycle operation, and ventilates the room R by the ventilation device to be described later.

The type of room R, which is air conditioned space to which the air conditioning and ventilating system S is applied, is not particularly limited in the present disclosure, and includes all spaces or areas that are cooled and/or heated and ventilated, such as offices, hotels, theaters, and stores. The air conditioning and ventilating system S includes an outdoor (heat source) unit 10 installed outside the room R, indoor units 20 installed inside the room R, a ventilation device 30, and a central controller 40. The outdoor unit 10 and the indoor units 20 constitute an air conditioning device A. The outdoor unit 10 and the indoor units 20 are connected by a liquid-refrigerant connection pipe 11 and a gas refrigerant connection pipe 12. In addition, the ventilation device 30 and the room R are connected by a supply air (SA) duct 31. Furthermore, the ventilation device 30 and the room R are connected by a return air (RA) duct 32. In the room R, the indoor units 20 may be installed on a floor, near a ceiling, or in ceiling space. Note that FIG. 1 depicts only two indoor units 20, but the number of indoor units 20 may be one, or three or more.

Figure 2:
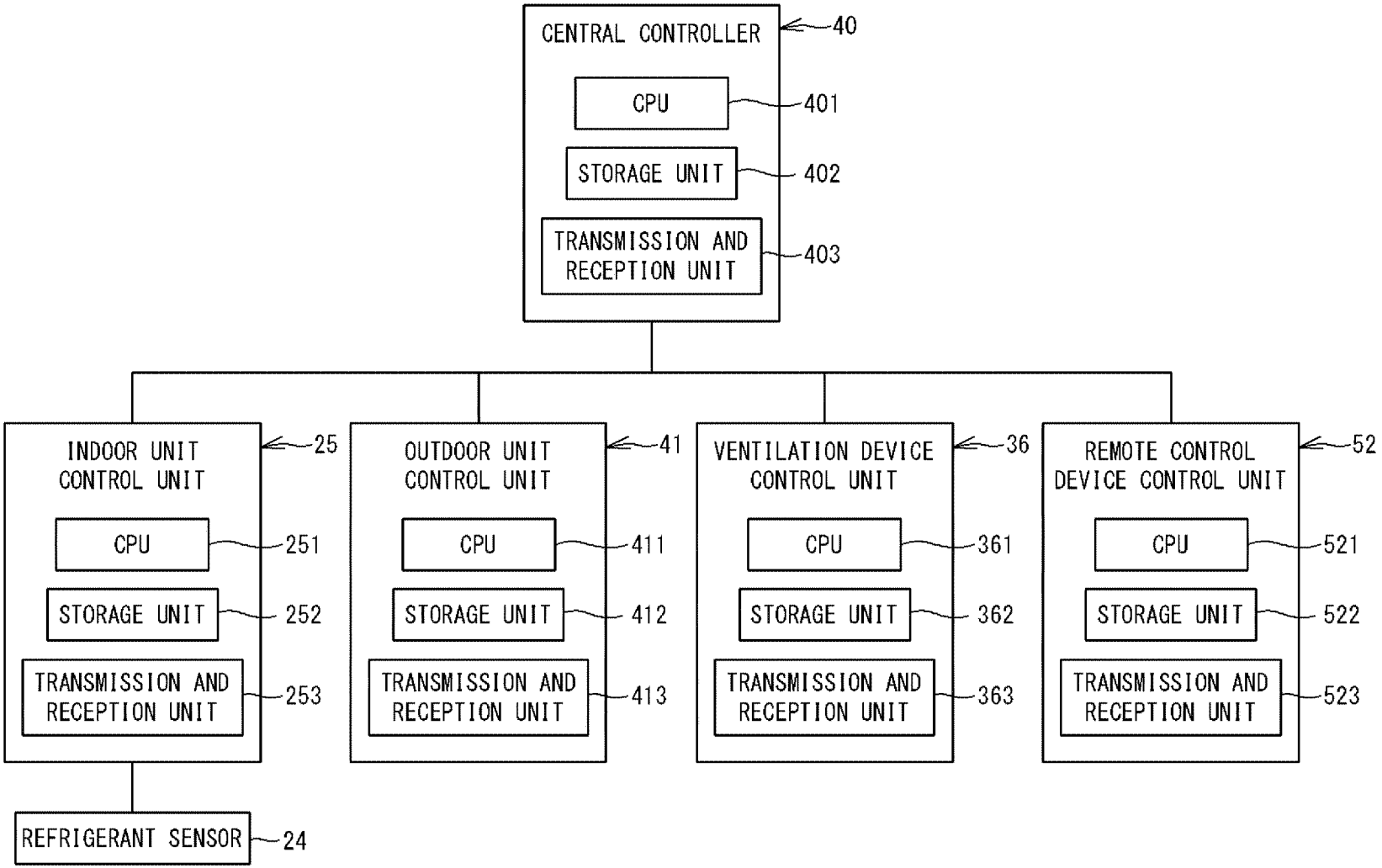
FIG. 2 is a block diagram showing configurations of a central controller and control units of an indoor unit, an outdoor unit, a ventilation device, and a remote control device.

The central controller 40 includes a CPU 401, a storage unit 402, and a transmission and reception unit 403, as shown in FIG. 2. The central controller 40 communicates with control units of the outdoor unit 10, the indoor units 20, and the ventilation device 30 to be described later via the transmission and reception unit 403 to control the operation of each device.

The outdoor unit 10 and the indoor units 20 can execute air conditioning of the room R by executing a well-known refrigeration cycle operation. Note that detailed description of a well-known refrigerant circuit inside each of the outdoor unit 10 and the indoor units 20 will be omitted, and only parts related to the present disclosure will be described below.

The outdoor unit 10 includes a compressor 13, a four-way switching valve 14, an outdoor heat exchanger 15, an outdoor expansion valve 16, a liquid shutoff valve 17, a gas shutoff valve 18, an outdoor fan 19, and a control unit 41.

The compressor 13 is a hermetic type compressor driven by a motor for the compressor (not shown), and takes in a gas refrigerant from an intake flow path 13*a* on an intake side of the compressor 13.

The four-way switching valve 14 is a mechanism for switching a refrigerant flow direction. As indicated by solid lines in FIG. 1, during a cooling operation, the four-way switching valve 14 connects a refrigerant pipe 13*b* on a discharge side of the compressor 13 to one end of the outdoor heat exchanger 15, and connects the intake flow path 13*a* on the intake side of the compressor 13 to the gas shutoff valve 18. With this configuration, the outdoor heat exchanger 15 functions as a condenser for the refrigerant compressed by the compressor 13, and an indoor heat exchanger to be described later functions as an evaporator for the refrigerant condensed by the outdoor heat exchanger 15.

In addition, as indicated by broken lines in FIG. 1, during a heating operation, the four-way switching valve 14 connects the refrigerant pipe 13*b* on the discharge side of the compressor 13 to the gas shutoff valve 18, and connects the intake flow path 13*a* to one end of the outdoor heat exchanger 15. With this configuration, the indoor heat exchanger functions as a condenser for the refrigerant compressed by the compressor 13, and the outdoor heat exchanger 15 functions as an evaporator for the refrigerant cooled by the indoor heat exchanger.

The outdoor fan 19 takes in outside air into the outdoor unit 10 and discharges, to the outdoors, outside air that has undergone heat exchange with the refrigerant flowing through the outdoor heat exchanger 15.

The control unit 41 includes a CPU 411, a storage unit 412, and a transmission and reception unit 413, as shown in FIG. 2. The control unit 41 is communicatively connected to the central controller 40 via the transmission and reception unit 413 to control the operation of the compressor 13 and the like.

The indoor units 20 are each connected to the outdoor unit 10 via the refrigerant connection pipes 11 and 12. The two indoor units 20 shown in FIG. 1 both have the same external and internal structure. Each indoor unit 20 includes an indoor expansion valve 21, an indoor heat exchanger 22, an indoor fan 23, a refrigerant sensor 24, and a control unit 25.

The indoor fan 23 takes in air of the room R into the indoor unit 20 and supplies air that has undergone heat exchange with the refrigerant flowing through the indoor heat exchanger 22 to the room R.

The refrigerant sensor 24 detects concentration of the refrigerant leaking from the refrigerant pipe or the like. The refrigerant sensor 24 continuously or intermittently outputs an electrical signal according to detected values to the control unit 25. This electrical signal varies in voltage according to the refrigerant concentration detected by the refrigerant sensor 24. The location of the refrigerant sensor 24 is not particularly limited if the leaked refrigerant can be detected. The refrigerant sensor 24 is preferably disposed, for example, near a place where the refrigerant is likely to leak, such as a joint point between the refrigerant pipes, a place where the refrigerant pipe is curved at 90 degrees or more, and a place where the pipe is thin. Note that in addition to being disposed inside the indoor unit 20, the refrigerant sensor 24 can also be mounted, for example, in the remote controller described later to set the room temperature, airflow volume, or the like, or can be disposed on a wall surface or other suitable place in the room.

The control unit 25 includes a CPU 251, a storage unit 252, and a transmission and reception unit 253, as shown in FIG. 2. The control unit 25 is communicatively connected to the central controller 40 via the transmission and reception unit 253. The control unit 25 controls the operation of the indoor fan 23 and the like in the indoor unit 20. The control unit 25 receives an electrical signal from the refrigerant sensor 24 via the transmission and reception unit 253. The storage unit 252 of the control unit 25 stores the voltage value corresponding to a first predetermined value regarding refrigerant leakage concentration. The first predetermined value refers to a value at which refrigerant leakage in the refrigerant circuit within the indoor unit 20 is assumed (refrigerant concentration). The voltage value corresponding to the first predetermined value is calculated from the relationship between the refrigerant concentration detected by the refrigerant sensor 24 and the voltage value of the electrical signal output by the refrigerant sensor 24. The control unit 25 determines whether the refrigerant concentration detected by the refrigerant sensor 24 is equal to or less than the first predetermined value to transmit a result thereof to the central controller 40. That is, the control unit 25 determines whether the voltage of the electrical signal received from the refrigerant sensor 24 is equal to or less than the voltage value corresponding to the first predetermined value.

The ventilation device 30 exchanges heat with fresh outside air OA and supplies the air to the room R as supply air SA, and discharges the return air RA from room R to the outside of the device. The ventilation device 30 includes a total heat exchanger 33, a supply air fan 34, an exhaust fan 35, and a control unit 36.

Figure 3:
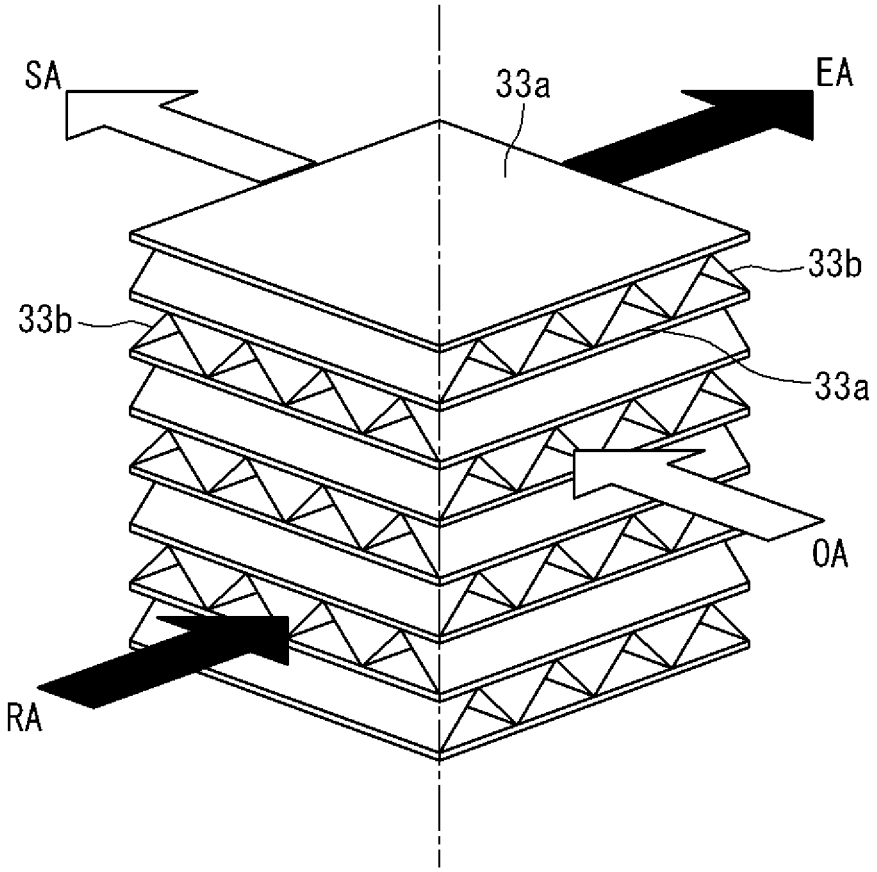
FIG. 3 is a perspective explanatory diagram showing a configuration of a total heat exchanger in the ventilation device.

The total heat exchanger 33 in the present embodiment is an orthogonal total heat exchanger configured such that the outside air OA from outside the room and the return air RA from inside the room R are almost orthogonal. The total heat exchanger 33 is, as shown in FIG. 3, a laminated body of a thermally conductive and moisture-permeable flat plate-shaped partition plate 33*a*, and a corrugated spacing plate 33*b* laminated in turn in the up-and-down direction in FIG. 3. The spacing plate 33*b* has a cross section that looks like nearly triangular cross sections arranged side by side when viewed from the ventilation direction (direction indicated by the hollow arrow or black arrow in FIG. 3), and keeps the flow path height by the height of the triangle. The spacing plate 33*b* is laminated at an angle of 90 degrees different at each sheet such that a corrugated cross section appears on every other sheet in the up-and-down direction (up-and-down direction in FIG. 3) on a certain side with the partition plate 33*a* interposed therebetween. With this configuration, a supply air side passage (see the hollow arrow in FIG. 3) and an exhaust side passage (see black arrow in FIG. 3) are formed with the thermally conductive and moisture-permeable partition plate 33*a* interposed therebetween. Sensible heat and latent heat are exchanged via the partition plate 33*a*. The ventilation device 30 in the present embodiment is a class 1 ventilation device in which air is supplied by a fan and exhausted by a fan. Note that as the ventilation device in the present disclosure, a class 2 ventilation device may be used, in which air is supplied by a fan and exhausted naturally, or a class 3 ventilation device may be used, in which air is exhausted by a fan and supplied naturally.

The control unit 36 includes a CPU 361, a storage unit 362, and a transmission and reception unit 363, as shown in FIG. 2. The control unit 36 is communicatively connected to the central controller 40 via the transmission and reception unit 363. The storage unit 362 stores data that associates a plurality of levels of set airflow volume with the number of revolutions of the supply air fan 34 and the exhaust fan 35 corresponding to the set airflow volume. The control unit 36 controls the number of revolutions of the supply air fan 34 and the exhaust fan 35 by referring to the data stored in the storage unit 362 based on the airflow volume set by a user.

In the present embodiment, a remote controller 50 is disposed in the room R. The remote controller 50 includes a display unit 51, a control unit 52, and an input unit 53. The display unit 51 displays information such as an operating mode of the indoor unit 20 and room temperature, and also displays that the leaked refrigerant concentration to be described later has exceeded the first predetermined value. The control unit 52 includes a CPU 521, a storage unit 522, and a transmission and reception unit 523, as shown in FIG. 2. The control unit 52 is communicatively connected to the control units 25 of the two indoor units 20, the control unit 36 of the ventilation device 30, and the central controller 40 via the transmission and reception unit 523 to control the operation of the remote controller 50. By manipulating the input unit 53, the user can adjust the temperature, start and stop the device operation, and the like.

The central controller 40 and the control units 25, 36, 41, and 52 each include a computer (CPU), and implement necessary control functions by the computer executing software (computer program). The software is stored in the storage unit of each of the central controller 40 and the control units 25, 36, 41, and 52. The central controller 40 and the control units 25, 36, 41, and 52 are connected to each other by communication lines, making it possible to coordinate control and share information.

[Basic Operation of Air Conditioning Device A]

The air conditioning device A having the above-described configuration executes the cooling operation or heating operation as follows.

During the cooling operation, as described above, the four-way switching valve 14 is in the state shown by the solid lines in FIG. 1. In this state, the high-pressure gas refrigerant discharged from the compressor 13 is sent to the outdoor heat exchanger 15 that functions as a condenser via the four-way switching valve 14, and is cooled by exchanging heat with the outside air supplied by the outdoor fan 19. The high-pressure refrigerant cooled and liquefied in the outdoor heat exchanger 15 is sent to each indoor unit 20 via the liquid-refrigerant connection pipe 11. The refrigerant sent to each indoor unit 20 is decompressed by the indoor expansion valve 21 to become a low-pressure gas-liquid two-phase state refrigerant, exchanges heat with the air of the room R in the indoor heat exchanger 22 that functions as an evaporator, and evaporates to become a low-pressure gas refrigerant. The low-pressure gas refrigerant heated in the indoor heat exchanger 22 is sent to the outdoor unit 10 via the gas-refrigerant connection pipe 12, and is taken in again into the compressor 13 via the four-way switching valve 14.

On the other hand, during the heating operation, as described above, the four-way switching valve 14 is in the state shown by the broken lines in FIG. 1. In this state, the high-pressure gas refrigerant discharged from the compressor 13 is sent to each indoor unit 20 via the four-way switching valve 14 and the gas-refrigerant connection pipe 12. The high-pressure gas refrigerant sent to each indoor unit 20 is sent to the indoor heat exchanger 22 that functions as a condenser, cooled by exchanging heat with the air of the room R, passes through the indoor expansion valve 21, and is sent to the outdoor unit 10 via the liquid-refrigerant connection pipe 11. The high-pressure refrigerant sent to the outdoor unit 10 is decompressed by the outdoor expansion valve 16 to become the low-pressure gas-liquid two-phase state refrigerant, and flows into the outdoor heat exchanger 15 that functions as an evaporator. The low-pressure gas-liquid two-phase state refrigerant that has flowed into the outdoor heat exchanger 15 is heated by exchanging heat with the outside air supplied by the outdoor fan 19, and evaporates to become a low-pressure refrigerant. The low-pressure gas refrigerant leaving the outdoor heat exchanger 15 is taken in again into the compressor 13 via the four-way switching valve 14.

[Basic Operation of Ventilation Device 30]

The operation of the ventilation device 30 is executed based on the user's instruction via the remote controller 50. In response to the user's instruction to start the operation of the ventilation device 30 at predetermined set airflow volume, the control unit 36 determines the number of revolutions of the supply air fan 34 and the exhaust fan 35, based on the data that associates the predetermined set airflow volume with the number of revolutions of the supply air fan 34 and the exhaust fan 35, the data being stored in the storage unit. The control unit 36 controls the rotation of the supply air fan 34 and the exhaust fan 35 based on the determined number of revolutions.

[Control of Air Conditioning and Ventilating System S when Refrigerant Leaks]

Figure 4:
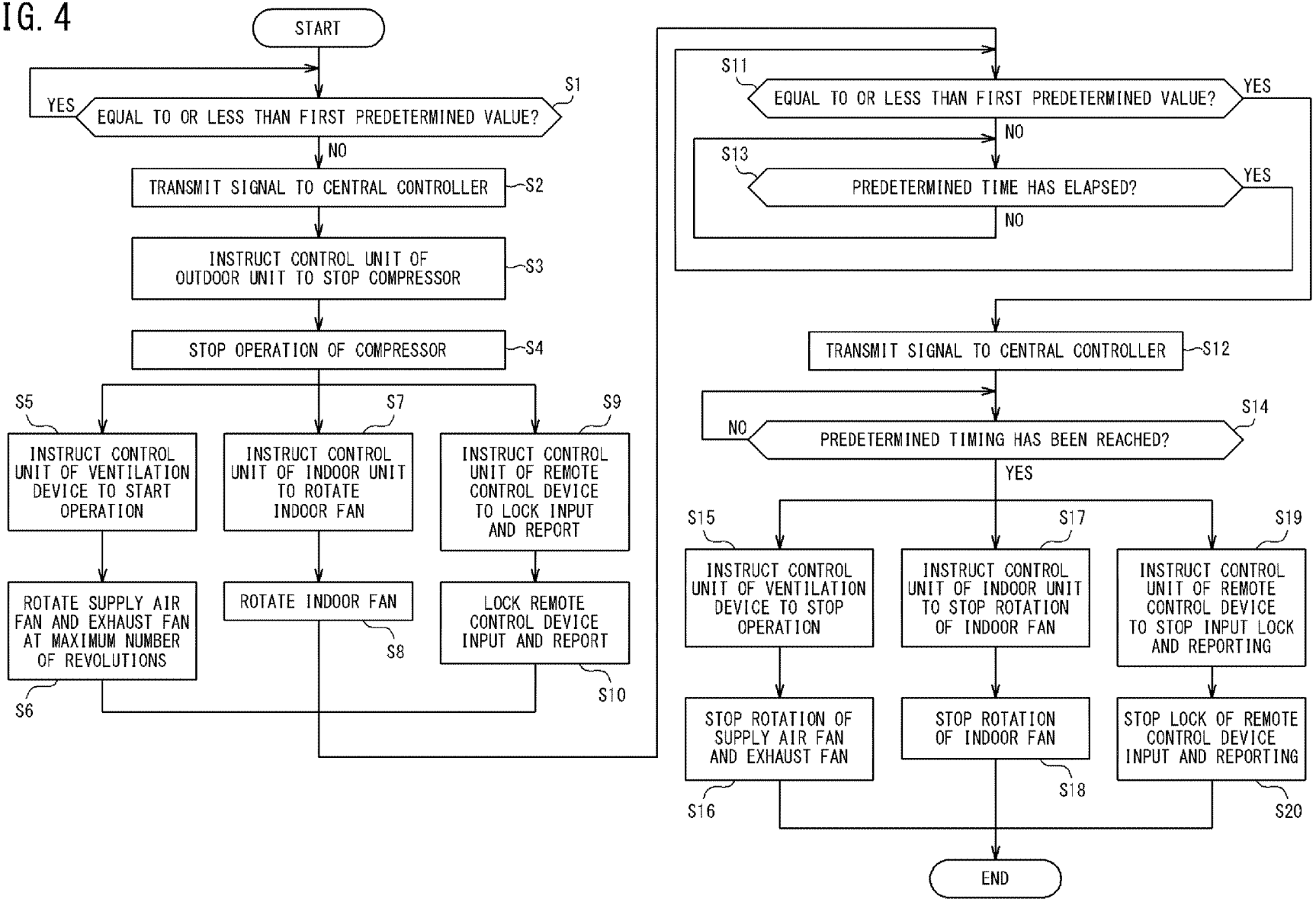
FIG. 4 is a flowchart showing one example of processing when a refrigerant leaks.

Next, the control of the air conditioning and ventilating system S when the refrigerant leaks will be described with reference to FIG. 4. FIG. 4 is a flowchart showing one example of processing when the refrigerant leaks.

In step S1, the CPU 251 of the control unit 25 of the indoor unit 20 determines whether the detected value from the refrigerant sensor 24 is equal to or less than the first predetermined value stored in the storage unit 252. On determination that the detected value exceeds the first predetermined value, the CPU 251 transmits a signal to the central controller 40 (step S2). On the other hand, on determination that the detected value is equal to or less than the first predetermined value, the CPU 251 returns to step S1.

In step S3, the CPU 401 of the central controller 40 instructs the control unit 41 of the outdoor unit 10 to stop the operation of the compressor 13.

In step S4, the CPU 411 of the control unit 41 sets the operation of the compressor 13 to the stop state. Note that "setting the operation to the stop state" has a meaning including both stopping the compressor 13 in the operating state and keeping the compressor 13 in the operation stop state as it is, as described above.

In step S5, the CPU 401 of the central controller 40 instructs the control unit 36 of the ventilation device 30 to start the operation of the ventilation device 30 and to maximize the ventilation airflow volume.

In step S6, the CPU 361 of the control unit 36 sets the ventilation device 30 to the operating state and rotates the supply air fan 34 and the exhaust fan 35 at the maximum number of revolutions such that the supply air fan 34 and the exhaust fan 35 have the maximum airflow volume out of the plurality of levels of airflow volume described above. Note that "setting the ventilation device 30 to the operating state" has a meaning including both keeping the ventilation device 30 in the operating state as it is and causing the ventilation device 30 in the operation stop state to operate into the operating state, as described above.

In step S7, the CPU 401 of the central controller 40 instructs the control unit 25 of the indoor unit 20 to rotate the indoor fan 23.

In step S8, the CPU 251 of the control unit 25 rotates the indoor fan 23.

In step S9, the CPU 401 of the central controller 40 instructs the control unit 52 of the remote controller (remote control device) 50 to lock (prohibit) input to the remote controller 50 and to report that the refrigerant is leaking.

In step S10, the CPU 521 of the control unit 52 causes a speaker (not shown) to emit an alarm sound and turns on a backlight of the display unit 51.

In step S11, the CPU 251 of the control unit 25 of the indoor unit 20 determines whether the detected value from the refrigerant sensor 24 is equal to or less than the first predetermined value stored in the storage unit 252. On determination that the detected value has become equal to or less than the first predetermined value, the CPU 251 sends a signal to the central controller 40 in the following step S12. On the other hand, on determination that the detected value is not equal to or less than the first predetermined value, the CPU 251 proceeds to step S13. In step S13, the CPU 251 determines whether the predetermined time has elapsed, and on determination that the predetermined time has elapsed, the CPU 251 returns to step S11. On the other hand, on determination that the predetermined time has not elapsed, the CPU 251 returns to step S13.

In step S14, the CPU 401 of the central controller 40 determines whether the predetermined timing has been reached, and on determination that the predetermined timing has been reached, the CPU 401 proceeds to step S15. Details including an example of this predetermined timing will be described later. On the other hand, on determination that the predetermined timing has not been reached, the CPU 401 returns to step S14.

In step S15, the CPU 401 of the central controller 40 instructs the control unit 36 of the ventilation device 30 to stop the operation of the ventilation device 30.

In step S16, the CPU 361 of the control unit 36 stops the rotation of the supply air fan 34 and the exhaust fan 35.

In step S17, the CPU 401 of the central controller 40 instructs the control unit 25 of the indoor unit 20 to stop the rotation of the indoor fan 23.

In step S18, the CPU 251 of the control unit 25 stops the rotation of the indoor fan 23.

In step S19, the CPU 401 of the central controller 40 instructs the control unit 52 of the remote controller (remote control device) 50 to stop the lock (prohibition) of input to the remote controller 50 and reporting that the refrigerant is leaking.

In step S20, the CPU 521 of the control unit 52 stops the lock of the remote control device input and reporting.

Note that in FIG. 4, steps S5, S7, and S9 are executed at the same time, but may be executed in the order of the step number, or the order may be changed. Similarly, steps S15, S17, and S19 may be executed in the order of the step number, or the order may be changed.

The following describes the "predetermined timing" in the present disclosure indicating the time to continue the stop of the operation of the compressor 13 and the operation of the ventilation device 30 even if the refrigerant concentration that has exceeded the first predetermined value becomes equal to or less than the first predetermined value. The "predetermined timing" is the timing when unevenness of the refrigerant concentration in the air conditioned space R is eliminated and the refrigerant concentration of the entire air conditioned space R becomes equal to or less than the first predetermined value, or when it is determined that the refrigerant concentration in the air conditioned space R has become equal to or less than the first predetermined value as a whole although the unevenness of the refrigerant concentration remains locally.

[Example 1 of Predetermined Timing]

One example of the "predetermined timing" can be set to the time when the refrigerant concentration that has exceeded the first predetermined value drops to a second predetermined value lower than the first predetermined value.

In this case, by continuing the stop state of the compressor 13 and the operating state of the ventilation device 30 until the refrigerant concentration drops to the second predetermined value lower than the first predetermined value, even if the refrigerant concentration in the air conditioned space R is uneven and the refrigerant concentration locally exceeds the first predetermined value, it is possible to inhibit the shortage of the ventilation volume of the air conditioned space. In this case, as the second predetermined value is set lower than the first predetermined value, it is possible to lengthen the time to continue the stop state of the compressor 13 and the operating state of the ventilation device 30, and to more reliably inhibit the shortage of the ventilation volume of the air conditioned space R.

[Example 2-1 of Predetermined Timing]

Another example of the "predetermined timing" can be set to the time when the predetermined time elapses after the refrigerant concentration that has exceeded the first predetermined value becomes equal to or less than the first predetermined value.

The "predetermined time" can be calculated based on at least one of, for example, the volume of the air conditioned space R, the ventilation capacity of the ventilation device 30, the refrigerant volume expected to leak to the air conditioned space R, and the refrigerant leakage velocity.

For example, the predetermined time can be set as follows. That is, the time calculated by dividing the total refrigerant volume Q (kg) of the air conditioning system including the indoor unit 20 by the minimum refrigerant outflow velocity vmin ($kg/m^3$) can be set as the predetermined time. In this case, the minimum refrigerant outflow velocity vmin ($kg/m^3$) can be determined by multiplication by the first predetermined value ($kg/m^3$), the volume V of the air conditioned space R ($m^3$), and the number of natural ventilations N of the air conditioned space R (times/s). The predetermined time in this case is set on the assumption that it takes the longest time for all the refrigerant to flow out when the refrigerant outflow velocity is at a minimum. The minimum refrigerant outflow velocity vmin ($kg/m^3$) is the velocity when the number of natural ventilations N of the air conditioned space R and the refrigerant outflow velocity are balanced, and can be expressed by $$vmin=N\times V\times Rf$$

where the predetermined refrigerant concentration (first predetermined value) is Rf (kg/m$^3$) and the volume of the air conditioned space R is V (m$^3$). Note that assuming that the air conditioned space R is highly airtight, the generally known number of natural ventilations N (times/s) at the time of high airtightness can be adopted. In addition, the volume of the air conditioned space R can also be calculated from the floor area and ceiling height, or can be estimated from the total horsepower of the indoor unit 20 because the room area corresponding to the horsepower of the indoor unit 20 is fixed.

[Example 2-2 of Predetermined Timing]

In addition, the predetermined time can be set based on the ventilation capacity (ventilation airflow volume) of the ventilation device 30. That is, the predetermined time can be determined by using the predicted refrigerant leakage velocity vcalc instead of vmin described above and dividing the total refrigerant volume Q (kg) by the predicted leakage velocity vcalc. If the ventilation capacity of the ventilation device 30 is Qvent (m$^3$/s), the predicted leakage velocity vcalc (kg/s) can be determined by multiplying the Qvent (m$^3$/s) by the refrigerant concentration Rsat (kg/m$^3$) when the refrigerant concentration is fully saturated. Here, the timing when the refrigerant concentration is saturated means the time when, after the refrigerant starts to leak and the refrigerant concentration of the air conditioned space R rises temporarily, the ventilation capacity of the ventilation device 30 and the refrigerant outflow velocity are balanced, and the refrigerant concentration of the air conditioned space R becomes constant. From the above description, the predetermined time can be determined by T=Q/(Qvent×Rsat). Note that it is assumed that the refrigerant volume that has flowed out before the refrigerant concentration reaches Rsat is ignored. By ignoring the refrigerant volume, ventilation will be executed longer than the minimum required time, but there is no problem from the viewpoint of improving safety.

[Example 2-3 of Predetermined Timing]

In addition, the predetermined time can also be determined by dividing the total refrigerant volume by the refrigerant leakage velocity. The refrigerant leakage velocity can be determined by using a generally known method. For example, the charged refrigerant volume charged in the refrigerant circuit is detected a plurality of times from information on the pressure and temperature of the refrigerant obtained by various sensors to calculate the charged refrigerant volume each time. Then, by dividing the difference between the charged refrigerant volumes each time by the detection time interval, it is possible to estimate the refrigerant leakage velocity, and by dividing the charged refrigerant volume by the obtained refrigerant leakage velocity, it is possible to determine the time until all the charged refrigerant leaks. The time determined in this way can be set as the predetermined time. In addition, by estimating the velocity with which the operating current of the compressor drops during the operation of the compressor as the refrigerant leakage velocity, and by dividing the total refrigerant volume by the estimated refrigerant leakage velocity, it is possible to determine the time until all the charged refrigerant leaks. The time determined in this way can be set as the predetermined time.

[Example 3 of Predetermined Timing]

Another example of the "predetermined timing" can be set to the time when the central controller 40 acquires the operation stop instruction. The operation stop instruction can be input into the remote controller 50, for example, by a service technician who confirms that the refrigerant concentration in the air conditioned space R has become equal to or less than the first predetermined value as a whole switching the remote controller 50 to a maintenance mode in which only the service technician can confirm the input. The operation stop instruction input into the remote controller 50 is transmitted to the central controller 40.

Action and Effect of Embodiment

In the air conditioning and ventilating system, depending on the size and shape of the air conditioned space, the location of the air conditioning device in the air conditioned space, and the like, unevenness may occur in the refrigerant concentration in the air conditioned space during the operation of the ventilation device or the air conditioning device for the refrigerant discharge. Therefore, even though the refrigerant concentration of the entire air conditioned space is not equal to or less than a predetermined value, if a sensor or the like that detects leaked refrigerant determines that the refrigerant concentration at the location where the sensor or the like is installed is equal to or less than the predetermined value, there is a risk that the operation of the ventilation device or the air conditioning device will be stopped, resulting in a shortage of ventilation volume for the air conditioned space. An object of the present disclosure is to provide an air conditioning and ventilating system that can inhibit the shortage of ventilation volume of air conditioned space due to unevenness of the refrigerant concentration in the air conditioned space.

In the present embodiment, even if the refrigerant concentration that has exceeded the first predetermined value becomes equal to or less than the first predetermined value, the central controller 40 sets the ventilation device 30 to the operating state until the predetermined timing to inhibit the shortage of the ventilation volume of the air conditioned space R. Furthermore, after the service technician (maintenance technician) or user confirms in the field that the leaked refrigerant is discharged from the air conditioned space R and the refrigerant concentration in the air conditioned space R is equal to or less than the first predetermined value as a whole, for example, the operation of the ventilation device 30 is continued until the operation of the ventilation device 30 is stopped by the manipulation of the remote controller 50, thereby making it possible to more reliably inhibit the shortage of the ventilation volume of the air conditioned space R.

In addition, in the present embodiment, the central controller 40 prohibits the operation manipulation with the remote controller 50 when the refrigerant concentration exceeds the first predetermined value. This makes it possible, for example, to prevent the user from operating the compressor 13 or stopping the operation of the ventilation device 30 without knowing the refrigerant leakage. As a result, it is possible to inhibit the shortage of the ventilation volume of the air conditioned space R by continuing the stop state of the compressor 13 and the operating state of the ventilation device 30.

In addition, in the present embodiment, on determination that the refrigerant concentration acquired from the refrigerant sensor 24 exceeds the first predetermined value, the central controller 40 increases the ventilation airflow volume of the ventilation device 30. Specifically, the ventilation airflow volume can be set, for example, 10 to 30% more than the ventilation airflow volume during the normal operation. By increasing the ventilation airflow volume of the ventilation device 30 more than during the normal operation, it is possible to promote discharge of the refrigerant leaked to the room R, from the room R.

In addition, in the present embodiment, on determination that the refrigerant concentration acquired from the refrigerant sensor 24 exceeds the first predetermined value, the central controller 40 sets the indoor fan 23 of the indoor unit 20 to the operating state. By setting the indoor fan 23 to the operating state to spread the leaked refrigerant, it is possible to reduce the unevenness of the refrigerant concentration in the room R.

[Other Modifications]

The present disclosure is not limited to the above-described embodiment, and various modifications may be made within the scope of the claims.

For example, in the embodiment, the number of outdoor units is one, but two or more outdoor units can be adopted. The number and arrangement of the outdoor unit, the indoor unit, and the ventilation device are not particularly limited in the present disclosure, and can be appropriately selected to constitute the air conditioning and ventilating system. In the embodiment shown in FIG. 1, one outdoor unit executes air conditioning of one air conditioned space, but the present disclosure can be applied to the case where one outdoor unit executes air conditioning of a plurality of air conditioned spaces. In each of the plurality of air conditioned spaces, the indoor unit, the refrigerant sensor, and the remote controller that execute air conditioning of the air conditioned space are disposed. In this case, on determination that at least one of the plurality of air conditioned spaces exceeds the first predetermined value, the central controller prohibits the operation manipulation with the remote controllers disposed in all the air conditioned spaces. When one refrigerant system executes air conditioning of the plurality of air conditioned spaces, if a refrigerant leakage occurs in one air conditioned space, the operation of the compressor of the air conditioning device enters the stop state, thereby also stopping the air conditioning of the air conditioned space where no refrigerant leakage occurs. Therefore, a user of the air conditioned space where no refrigerant leakage occurs may manipulate the remote controller in order to resume the operation of the compressor of the air conditioning device. As described above, by prohibiting the operation manipulation with the remote controllers disposed in all the air conditioned spaces, it is possible to reduce the degree of refrigerant leakage and to prevent the operation of the ventilation device from being stopped. As a result, it is possible to inhibit the shortage of the ventilation volume of all the air conditioned spaces including the air conditioned space where the refrigerant leaks by continuing the stop state of the compressor of the air conditioning device and the operating state of the ventilation device.

In addition, in the embodiment, the central controller is disposed as another control unit different from the control unit 25 of the indoor unit 20, but it is also possible to cause the control unit 25 of either indoor unit 20 to have functions as the central controller 40. In this case, the control unit 25 having the functions as the central controller 40 (hereafter, also referred to as main control unit 25) and the control unit 36 of the ventilation device 30 do not have to be directly and communicatively connected to each other. The control unit 36 may be communicatively connected to only another control unit 25 (sub control unit 25) connected to the main control unit 25. In this case, the control unit 36 communicates with the main control unit 25 via the sub control unit 25. Similarly when there are three or more indoor units 20, not all the control units 25 need to be directly connected to the main control unit 25 communicatively.

In addition, in the embodiment, when the refrigerant leaks, the control unit 36 of the ventilation device 30 rotates the supply air fan 34 and the exhaust fan 35 at the maximum number of revolutions, but this is not restrictive.

In addition, in the embodiment, when the refrigerant leaks, the control unit 25 of the indoor unit 20 rotates the indoor fan 23, but does not necessarily need to rotate the indoor fan 23.

In addition, in the embodiment, the orthogonal total heat exchanger is disposed in the ventilation device, but a rotary total heat exchanger that recovers heat from the return air by rotating a rotor can also be adopted. In addition, the adoption of such a total heat exchanger in the ventilation device can also be omitted.

REFERENCE SIGNS LIST

10 outdoor unit
11 liquid refrigerant pipe
12 gas refrigerant pipe
13 compressor
14 four-way switching valve
15 outdoor heat exchanger
16 outdoor expansion valve
17 liquid shutoff valve
18 gas shutoff valve
19 outdoor fan
20 indoor unit
21 indoor expansion valve
22 indoor heat exchanger
23 indoor fan
24 refrigerant sensor
25 control unit
30 ventilation device
31 supply air duct
32 return air duct
33 total heat exchanger
34 supply air fan
35 exhaust fan
36 control unit
40 central controller
41 control unit
50 remote controller
51 display unit
52 control unit
53 input unit
251 CPU
252 storage unit
253 transmission and reception unit
361 CPU
362 storage unit
363 transmission and reception unit
401 CPU
402 storage unit
403 transmission and reception unit
411 CPU
412 storage unit
413 transmission and reception unit
521 CPU

522 storage unit
523 transmission and reception unit
A air conditioning device
R room (air conditioned space)
S air conditioning and ventilating system

The invention claimed is:

1. An air conditioning and ventilating system comprising:

an air conditioning device including a heat exchanger configured to generate conditioned air by heat exchange with a refrigerant, and configured to send the conditioned air to an air conditioned space;

a ventilator configured to ventilate the air conditioned space by exhausting air from the air conditioned space;

a refrigerant sensor configured to detect concentration of the refrigerant in the air conditioned space; and a controller configured to control operations of the air conditioning device and the ventilator, and prevent a shortage of a ventilation volume of air in the air conditioned space in a presence of an unevenness of the refrigerant concentration in an entire space of the air conditioned space, wherein on determination that the refrigerant concentration acquired from the refrigerant sensor exceeds a first predetermined value, the controller sets an operation of a compressor of the air conditioning device to a stop state and sets the ventilator to an operating state, on determination that the refrigerant concentration that has exceeded the first predetermined value becomes equal to or less than the first predetermined value, the controller continues the stop state of the compressor of the air conditioning device and the operating state of the ventilator until predetermined timing to prevent the shortage of the ventilation volume of air in the air conditioned space;

the predetermined timing is a time when a predetermined time elapses after the refrigerant concentration that has exceeded the first predetermined value becomes equal to or less than the first predetermined value, the predetermined time is calculated based on at least one of volume of the air conditioned space, ventilation capacity of the ventilator, refrigerant volume expected to leak to the air conditioned space, and refrigerant leakage velocity, the predetermined timing is a time calculated by dividing a total refrigerant volume of the air conditioning device by a minimum refrigerant outflow velocity, and the minimum refrigerant outflow velocity is calculated by multiplication by the first predetermined value, the volume of the air conditioned space, and a number of natural ventilations of the air conditioned space.

2. The air conditioning and ventilating system according to claim 1, further comprising a remote controller configured to manipulate the operation of the air conditioning device and/or ventilator, wherein when the refrigerant concentration exceeds the first predetermined value, the controller prohibits the operation manipulation with the remote controller.

3. The air conditioning and ventilating system according to claim 2, wherein the air conditioning device includes a plurality of indoor units configured to execute air conditioning of a plurality of the air conditioned spaces, and an outdoor unit connected to the plurality of indoor units, the refrigerant sensor comprises a plurality of refrigerant sensors and the remote controller comprises a plurality of remote controllers, one of the plurality of refrigerant sensors and one of the plurality of remote controllers are disposed in each of the plurality of air conditioned spaces, and on determination that at least one of the plurality of air conditioned spaces exceeds the first predetermined value, the controller prohibits the operation manipulation with the remote controllers disposed in all the air conditioned spaces.

4. The air conditioning and ventilating system according to claim 1, wherein on determination that the refrigerant concentration acquired from the refrigerant sensor exceeds the first predetermined value, the controller increases ventilation airflow volume of the ventilator.

5. The air conditioning and ventilating system according to claim 1, wherein on determination that the refrigerant concentration acquired from the refrigerant sensor exceeds the first predetermined value, the controller sets an indoor fan of the air conditioning device to an operating state.

6. The air conditioning and ventilating system according to claim 1, further comprising a display unit configured to display that the leaked refrigerant has exceeded the first predetermined value.

7. An air conditioning and ventilating system comprising:

an air conditioning device including a heat exchanger configured to generate conditioned air by heat exchange with a refrigerant, and configured to send the conditioned air to an air conditioned space;

a ventilator configured to ventilate the air conditioned space by exhausting air from the air conditioned space;

a refrigerant sensor configured to detect concentration of the refrigerant in the air conditioned space; and a controller configured to control operations of the air conditioning device and the ventilator, and prevent a shortage of a ventilation volume of air in the air conditioned space in a presence of an unevenness of the refrigerant concentration in an entire space of the air conditioned space, wherein on determination that the refrigerant concentration acquired from the refrigerant sensor exceeds a first predetermined value, the controller sets an operation of a compressor of the air conditioning device to a stop state and sets the ventilator to an operating state, on determination that the refrigerant concentration that has exceeded the first predetermined value becomes equal to or less than the first predetermined value, the controller continues the stop state of the compressor of the air conditioning device and the operating state of the ventilator until predetermined timing to prevent the shortage of the ventilation volume of air in the air conditioned space, the predetermined timing is a time when a predetermined time elapses after the refrigerant concentration that has exceeded the first predetermined value becomes equal to or less than the first predetermined value, the predetermined time is calculated based on at least one of volume of the air conditioned space, ventilation capacity of the ventilator, refrigerant volume expected to leak to the air conditioned space, and refrigerant leakage velocity, the predetermined time is a time calculated by dividing a total refrigerant volume of the air conditioning device by a predicted leakage velocity, and the predicted leakage velocity is calculated by multiplication by the ventilation capacity of the ventilator by a refrigerant concentration when the refrigerant concentration is fully saturated.

8. An air conditioning and ventilating system comprising:

an air conditioning device including a heat exchanger configured to generate conditioned air by heat exchange with a refrigerant, and configured to send the conditioned air to an air conditioned space;

a ventilator configured to ventilate the air conditioned space by exhausting air from the air conditioned space;

a refrigerant sensor configured to detect concentration of the refrigerant in the air conditioned space; and a controller configured to control operations of the air conditioning device and the ventilator, and prevent a shortage of a ventilation volume of air in the air conditioned space in a presence of an unevenness of the refrigerant concentration in an entire space of the air conditioned space, wherein on determination that the refrigerant concentration acquired from the refrigerant sensor exceeds a first predetermined value, the controller sets an operation of a compressor of the air conditioning device to a stop state and sets the ventilator to an operating state, on determination that the refrigerant concentration that has exceeded the first predetermined value becomes equal to or less than the first predetermined value, the controller continues the stop state of the compressor of the air conditioning device and the operating state of the ventilator until predetermined timing to prevent the shortage of the ventilation volume of air in the air conditioned space, the predetermined timing is a time when a predetermined time elapses after the refrigerant concentration that has exceeded the first predetermined value becomes equal to or less than the first predetermined value, the predetermined time is calculated based on at least one of volume of the air conditioned space, ventilation capacity of the ventilator, refrigerant volume expected to leak to the air conditioned space, and refrigerant leakage velocity, and the predetermined time is a time calculated by dividing a total refrigerant volume of the air conditioning device by an actual refrigerant leakage velocity.

* * * * *